US011024228B2

(12) United States Patent
Wang et al.

(10) Patent No.: US 11,024,228 B2
(45) Date of Patent: Jun. 1, 2021

(54) PIXEL CIRCUIT, DRIVING METHOD THEREFOR AND DISPLAY DEVICE

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Xin Wang, Beijing (CN); Ying Liu, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 254 days.

(21) Appl. No.: 16/088,600

(22) PCT Filed: Feb. 8, 2018

(86) PCT No.: PCT/CN2018/075781

§ 371 (c)(1),
(2) Date: Sep. 26, 2018

(87) PCT Pub. No.: WO2018/166312

PCT Pub. Date: Sep. 20, 2018

(65) Prior Publication Data

US 2020/0302859 A1 Sep. 24, 2020

(30) Foreign Application Priority Data

Mar. 13, 2017 (CN) ..... 201710147593.8

(51) Int. Cl.
*G09G 3/325* (2016.01)
*G09G 3/3291* (2016.01)

(52) U.S. Cl.
CPC ..... *G09G 3/325* (2013.01); *G09G 3/3291* (2013.01); *G09G 2300/0842* (2013.01)

(58) Field of Classification Search
CPC ..... G09G 3/325; G09G 3/3291; G09G 2300/0842; G09G 3/3233;
(Continued)

(56) References Cited

U.S. PATENT DOCUMENTS 10,140,928 B2 11/2018 Wang et al.
2007/0103406 A1* 5/2007 Kim ..... G09G 3/3233 345/76

(Continued)

FOREIGN PATENT DOCUMENTS

CN 103927981 A 7/2014
CN 104157240 A 11/2014

(Continued)

OTHER PUBLICATIONS

International Search Report of PCT/CN2018/075781 in Chinese, dated May 10, 2018, with English translation.

(Continued)

*Primary Examiner* — Kent W Chang
*Assistant Examiner* — Sujit Shah
(74) *Attorney, Agent, or Firm* — Collard & Roe, P.C.

(57) ABSTRACT

A pixel circuit and a driving method thereof, and a display device are disclosed. The pixel circuit includes: an initialization sub-circuit, configured to initialize a drive sub-circuit; a data write and compensation sub-circuit, configured to perform threshold voltage compensation on the drive sub-circuit; the drive sub-circuit, configured to output a signal of a second voltage terminal to a light-emitting sub-circuit; the light-emitting sub-circuit, configured to under control of the enable signal terminal input a signal of a first voltage terminal to the drive sub-circuit to control the (Continued)

drive sub-circuit to be turned on, and emit light under control of the enable signal terminal and a third voltage terminal; a leakage-current eliminating sub-circuit, configured to under the control of the enable signal terminal cause the initialization sub-circuit to output no signal to an initial voltage terminal when the initialization sub-circuit is in a turn-off state.

9 Claims, 6 Drawing Sheets

(58) Field of Classification Search
CPC ... G09G 2300/0819; G09G 2300/0861; G09G 3/3266
USPC ..... 345/204
See application file for complete search history.

(56) References Cited

U.S. PATENT DOCUMENTS

2010/0141644 A1 6/2010 Lee et al.
2014/0111503 A1* 4/2014 Kwon ..... G09G 3/3233 345/213
2014/0168180 A1* 6/2014 Kim ..... H05B 45/60 345/205
2015/0028766 A1* 1/2015 Yang ..... G09G 3/3233 315/240
2015/0269885 A1 9/2015 Ma
2016/0335954 A1 11/2016 Hung et al.
2017/0047390 A1* 2/2017 Lee ..... G09G 3/3233
2018/0047337 A1* 2/2018 Zhu ..... G09G 3/3233

FOREIGN PATENT DOCUMENTS

CN 104751775 A 7/2015
CN 105006218 A 10/2015
CN 106875894 A 6/2017

OTHER PUBLICATIONS

Notice of Transmittal of the International Search Report of PCT/CN2018/075781 in Chinese, dated May 10, 2018.
Written Opinion of the International Searching Authority of PCT/CN2018/075781 in Chinese, dated May 10, 2018, with English translation.

* cited by examiner

PIXEL CIRCUIT, DRIVING METHOD THEREFOR AND DISPLAY DEVICE

CROSS-REFERENCE TO RELATED APPLICATION

This application is the National Stage of PCT/CN2018/075781 filed on Feb. 8, 2018, which claims priority under 35 U.S.C. § 119 of Chinese Application No. 201710147593.8 filed on Mar. 13, 2017, the disclosure of which is incorporated by reference.

TECHNICAL FIELD

The embodiments of the present disclosure relate to a pixel circuit and a driving method thereof, and a display device.

BACKGROUND

An organic light emitting diode (OLED) display is one of hotspots in current research fields. Compared with a liquid crystal display (LCD), an OLED display has advantages such as low energy consumption, low production cost, self-illumination, wide viewing angle, fast response speed, and the like; the design of a pixel circuit is a core technology content of the OLED display, and has important research significance.

During an image display phase of each frame, in an actual operation process, it cannot be ensured that transistors in a pixel circuit are completely turned off without loss, and electric leakage can occur when the transistors cannot be completely turned off.

SUMMARY

In a first aspect, an embodiment of the present disclosure provides a pixel circuit, comprising: an initialization module, a data write and compensation module, a drive module, a light-emitting unit, and a leakage-current eliminating module. The initialization module is configured to be respectively connected to the drive module, a first signal terminal, a first voltage terminal and an initial voltage terminal, and is configured to, under control of the first signal terminal, input a signal of the initial voltage terminal and a signal of the first voltage terminal to the drive module to initialize the drive module; the data write and compensation module is configured to be respectively connected to the drive module, a scan signal terminal and a data voltage terminal, and is configured to, under control of the scan signal terminal, write a signal of the data voltage terminal to the drive module to perform threshold voltage compensation on the drive module; the drive module is configured to be further connected to the light-emitting unit and a second voltage terminal, and is configured to output a signal of the second voltage terminal to the light-emitting unit in a turn-on state, so as to drive the light-emitting unit to emit light; the light-emitting unit is configured to be further connected to the first voltage terminal, an enable signal terminal and a third voltage terminal, and is configured to, under control of the enable signal terminal, input the signal of the first voltage terminal to the drive module to control the drive module to be turned on, and emit light under control of the enable signal terminal and the third voltage terminal; and the leakage-current eliminating module is configured to be respectively connected to the initialization module, the drive module and the enable signal terminal, and is configured to, under the control of the enable signal terminal, cause the initialization module to output no signal to the initial voltage terminal when the initialization module is in a turn-off state.

For example, the leakage-current eliminating module comprises a first transistor, a gate electrode of the first transistor is connected to the enable signal terminal, a first electrode of the first transistor is connected to the drive module, and a second electrode of the first transistor is connected to the initialization module.

For example, the drive module comprises a storage capacitor and a driving transistor, a first end of the storage capacitor is connected to the initialization module, the data write, compensation module, and the light-emitting unit, and a second end of the storage capacitor is connected to a gate electrode of the driving transistor; a first electrode of the driving transistor is connected to the second voltage terminal, and a second electrode of the driving transistor is connected to the light-emitting unit, the data write and compensation module.

For example, the initialization module comprises a second transistor, a third transistor and a fourth transistor; a gate electrode of the second transistor is connected to the first signal terminal, a first electrode of the second transistor is connected to the first voltage terminal, and a second electrode of the second transistor is connected to the first end of the storage capacitor; a gate electrode of the third transistor is connected to the first signal terminal, a first electrode of the third transistor is connected to the first signal terminal, and a second electrode of the third transistor is connected to a gate electrode of the fourth transistor; a first electrode of the fourth transistor is connected to the initial voltage terminal, and a second electrode of the fourth transistor is connected to the second end of the storage capacitor.

For example, the data write and compensation module comprises a fifth transistor and a sixth transistor; a gate electrode of the fifth transistor is connected to the scan signal terminal, a first electrode of the fifth transistor is connected to the data voltage terminal, and a second electrode of the fifth transistor is connected to the first end of the storage capacitor; a gate electrode of the sixth transistor is connected to the scan signal terminal, a first electrode of the sixth transistor is connected to the second electrode of the driving transistor, and a second electrode of the sixth transistor is connected to the second end of the storage capacitor.

For example, the light-emitting unit comprises a seventh transistor, an eighth transistor, and a light-emitting component; a gate electrode of the seventh transistor is connected to the enable signal terminal, a first electrode of the seventh transistor is connected to the first voltage terminal, and a second electrode of the seventh transistor is connected to the first end of the storage capacitor; a gate electrode of the eighth transistor is connected to the enable signal terminal, a first electrode of the eighth transistor is connected to the second electrode of the driving transistor, and a second electrode of the eighth transistor is connected to an anode of the light-emitting component; a cathode of the light-emitting component is connected to the third voltage terminal; the seventh transistor and the eighth transistor are first-type transistors, and the first transistor is a second-type transistor.

For example, the seventh transistor and the eighth transistor are P-type transistors, and the first transistor is an N-type transistor; or the seventh transistor and the eighth transistor are N-type transistors, and the first transistor is a P-type transistor.

For example, the gate electrode of the first transistor is connected to the enable signal terminal, the first electrode of the first transistor is connected to the second electrode of the fourth transistor, and the second electrode of the first transistor is connected to the gate electrode of the fourth transistor.

In a second aspect, an embodiment of the present disclosure provides a display device, comprising the pixel circuit in the first aspect.

In a third aspect, an embodiment of the present disclosure provides a driving method of the pixel circuit, comprising: in an initialization phase of a frame, under control of a first signal terminal, inputting, by an initialization module, a signal of an initial voltage terminal and a signal of a first voltage terminal to a drive module to initialize the drive module; in a data writing phase of the frame, under control of a scan signal terminal, writing, by a data write and compensation module, a signal of a data voltage terminal to the drive module to perform threshold voltage compensation on the drive module; under control of an enable signal terminal, causing, by a leakage-current eliminating module, the initialization module to output no signal to the initial voltage terminal when the initialization module is in a turn-off state; in a light-emitting phase of the frame, under the control of the enable signal terminal, inputting the signal of the first voltage terminal to the drive module to control the drive module to be turned on, and controlling a light-emitting unit to emit light under control of the enable signal terminal and a third voltage terminal.

For example, the leakage-current eliminating module comprises a first transistor, the initialization module comprises a fourth transistor, and the drive module comprises a storage capacitor. Under the control of the enable signal terminal, causing, by a leakage-current eliminating module, the initialization module to output no signal to the initial voltage terminal when the initialization module is in a turn-off state, comprises: in the data writing phase, controlling the first transistor to be turned on by the enable signal terminal, inputting a voltage of a second end of the storage capacitor to a gate electrode of the fourth transistor via the first transistor, making a voltage of the gate electrode of the fourth transistor and a voltage of a second electrode of the fourth transistor both equal to the voltage of the second end of the storage capacitor, a gate-source voltage of the fourth transistor being zero voltage; where in the light-emitting phase, the enable signal terminal controls the first transistor to be turned off and the fourth transistor to be turned off, a current of the fourth transistor is a zero current, so that no signal is output to the initial voltage terminal.

BRIEF DESCRIPTION OF THE DRAWINGS

In order to clearly illustrate the technical solutions of the embodiments of the present disclosure or the technical solutions in the prior art, the drawings required for describing the embodiments or the prior art will be briefly described in the following; it is obvious that the described drawings below are only related to some embodiments of the disclosure, those skilled in the art can obtain other drawing(s) based on these drawings, without any inventive work.

REFERENCE NUMBERS

10—initialization module; 20—data write and compensation module; 30—drive module; 40—light-emitting unit; 50—leakage-current eliminating module.

DETAILED DESCRIPTION

The technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Figure 1:
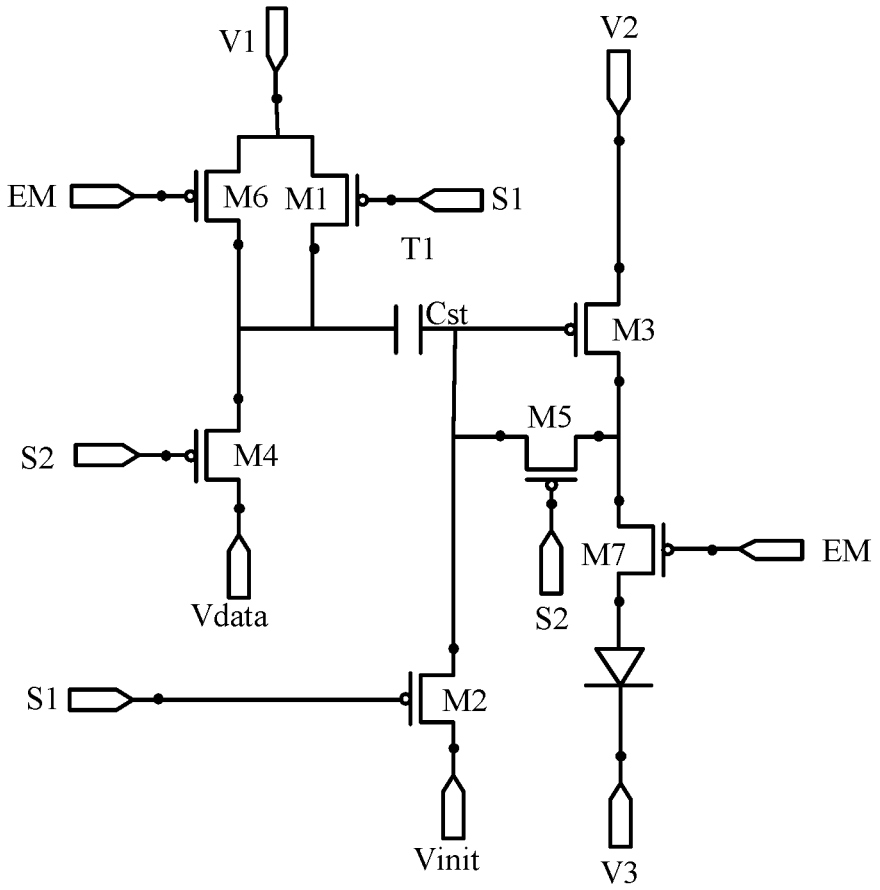
FIG. 1 is a schematic structural diagram of a pixel circuit.

A display area of a display panel comprises a plurality of pixel circuits. As shown in FIG. 1, in a light-emitting phase of the pixel circuit, because the second transistor M2 cannot be completely turned off, resulting in that a portion of the electric current flowing from the driving transistor M3 to the light-emitting component leaks into the path through transistors M3-M5-M2, thus the current flowing through the light-emitting component is unstable, the brightness of the light-emitting component is affected, and a phenomenon of flicker easily occurs when the light-emitting component emits light.

Embodiments of the present disclosure provide a pixel circuit, a driving method thereof, and a display device, which can reduce a leakage current in the pixel circuit.

Embodiment of the present disclosure provides a pixel circuit, a driving method thereof, and a display device, by adding a leakage-current eliminating module connected to an initialization module in the pixel circuit, in a phase when the initialization module is turned off, under the control of the leakage-current eliminating module, the initialization module does not output a signal to an initial voltage terminal (that is, in the light-emitting phase, the current flowing to the light-emitting component does not leak into other paths), thereby ensuring the stability of the current flowing into the light-emitting unit, avoiding a flicker problem of the light-emitting unit during the light-emitting process, and reducing power consumption of the pixel circuit to some extent.

Figure 2:
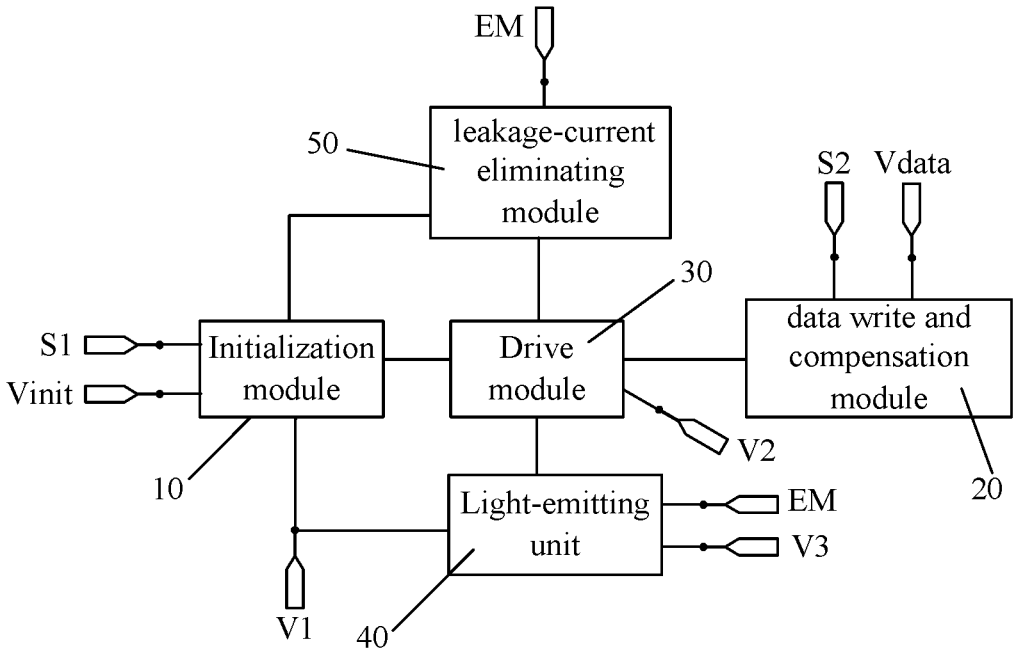
FIG. 2 is a schematic structural diagram of a pixel circuit provided by an embodiment of the present disclosure.

An embodiment of the present disclosure provides a pixel circuit, as shown in FIG. 2, comprising: an initialization module 10, a data write and compensation module 20, a drive module 30, a light-emitting unit 40, and a leakage-current eliminating module 50.

Specifically, the initialization module 10 is respectively connected to the drive module 30, a first signal terminal S1, a first voltage terminal V1 and an initial voltage terminal Vinit, and is configured to, under the control of the first signal terminal S1, input a signal of the initial voltage terminal Vinit and a signal of the first voltage terminal V1 to the drive module 30 and initialize the drive module 30.

The data write and compensation module 20 is respectively connected to the drive module 30, a scan signal terminal S2 and a data voltage terminal Vdata, and is configured to, under the control of the scan signal terminal S2, write a signal of the data voltage terminal Vdata to the drive module 30 and perform threshold voltage compensation on the drive module 30.

The drive module 30 is further connected to the light-emitting unit 40 and a second voltage terminal V2, and is configured to output a signal of the second voltage terminal V2 to the light-emitting unit 40 in a turn-on state, so as to drive the light-emitting unit 40 to emit light.

The light-emitting unit 40 is further connected to the first voltage terminal V1, an enable signal terminal EM and a third voltage terminal V3, and is configured to, under the control of the enable signal terminal EM, input the signal of the first voltage terminal V1 to the drive module 30 to control the drive module 30 to be turned on, and emit light under the control of the enable signal terminal EM and the third voltage terminal V3.

The leakage-current eliminating module 50 is respectively connected to the initialization module 10, the drive module 30 and the enable signal terminal EM, and is configured to, under the control of the enable signal terminal EM, cause the initialization module 10 to output no signal to the initial voltage terminal Vinit when the initialization module 10 is in a turn-off state.

Because a current of a light-emitting component (such as, an organic light-emitting diode) in a single pixel is only in a nano-ampere (nA) level during a light-emitting phase, even a small leakage current has a significant influence on the light-emitting phase. An embodiment of the present disclosure provides a pixel circuit, the leakage-current eliminating module 50 connected to the initialization module 10 is added in the pixel circuit, so that in the phase when the initialization module 10 is turned off, under the control of the leakage-current eliminating module 50, the initialization module 10 has no signal to output to the initial voltage terminal Vinit (that is, in the light-emitting phase, the current flowing to the light-emitting component does not leak into other paths), thereby ensuring the stability of the current flowing into the light-emitting unit 40, avoiding a flicker problem of the light-emitting unit 40 during a light-emitting process, and reducing power consumption of the pixel circuit to some extent.

Figure 3:
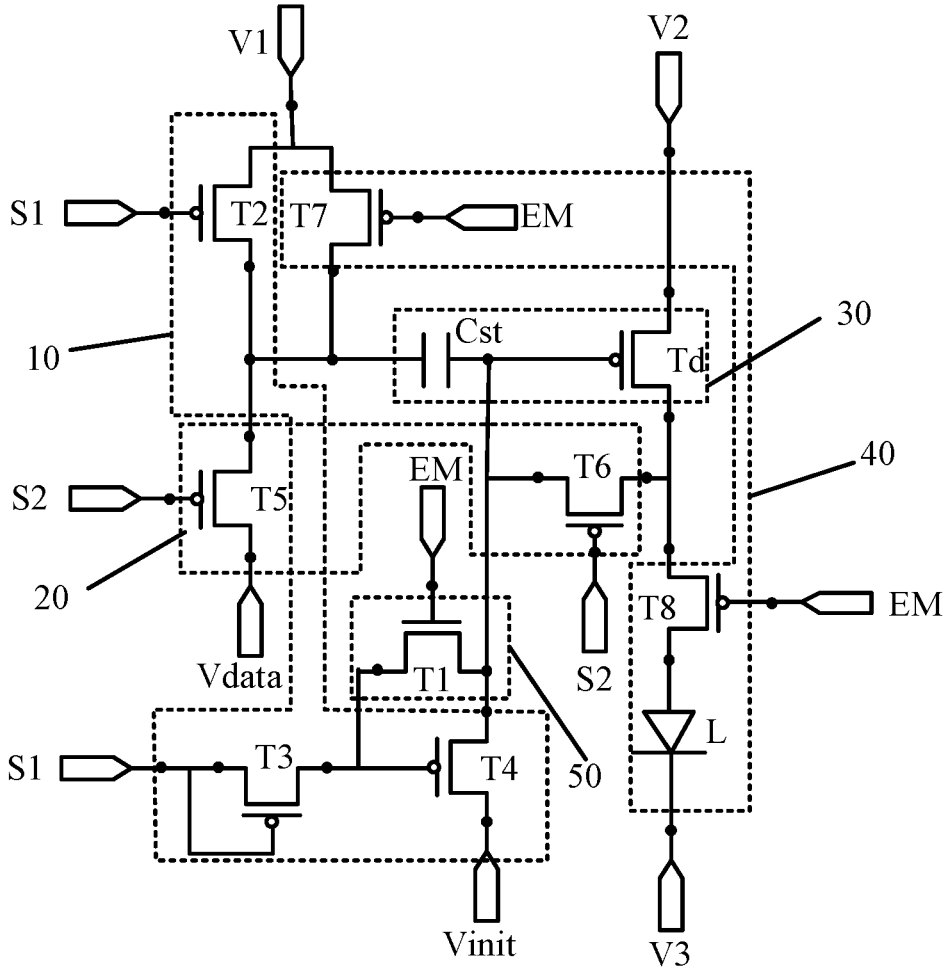
FIG. 3 is a schematic structural diagram of an example of respective modules of the pixel circuit shown in FIG. 2.

More specifically, as shown in FIG. 3, the leakage-current eliminating module 50 comprises a first transistor T1 for example.

A gate electrode of the first transistor T1 is connected to the enable signal terminal EM, a first electrode of the first transistor T1 is connected to the drive module 30, and a second electrode of the first transistor T1 is connected to the initialization module 10.

It should be noted that, the leakage-current eliminating module 50 may further comprise a plurality of first transistors T1 connected in parallel. What have been described above is merely exemplary illustration of the leakage-current eliminating module 50, and other structures having the same functions as the leakage-current eliminating module 50 will not be described in detail herein, but are all intended to fall within the protection scope of the present disclosure.

As shown in FIG. 3, the drive module 30 comprises a storage capacitor Cst and a driving transistor Td for example.

A first end of the storage capacitor Cst is connected to the initialization module 10, the data write and compensation module 20, and the light-emitting unit 40, and a second end of the storage capacitor Cst is connected to a gate electrode of the driving transistor Td and the first electrode of the first transistor T1.

A first electrode of the driving transistor Td is connected to the second voltage terminal V2, and a second electrode of the driving transistor Td is connected to the light-emitting unit 40 and the data write and compensation module 20.

It should be noted that, the drive module 30 may further comprise a plurality of driving transistors Td connected in parallel. What have been described above is merely exemplary illustration of the drive module 30, and other structures having the same functions as the drive module 30 will not be described in detail herein, but are all intended to fall within the protection scope of the present disclosure.

As shown in FIG. 3, the initialization module 10 comprises a second transistor T2, a third transistor T3 and a fourth transistor T4.

A gate electrode of the second transistor T2 is connected to the first signal terminal S1, a first electrode of the second transistor T2 is connected to the first voltage terminal V1, and a second electrode of the second transistor T2 is connected to the first end of the storage capacitor Cst.

A gate electrode of the third transistor T3 is connected to the first signal terminal S1, a first electrode of the third transistor T3 is connected to the first signal terminal S1, and a second electrode of the third transistor T3 is connected to a gate electrode of the fourth transistor T4.

A first electrode of the fourth transistor T4 is connected to the initial voltage terminal Vinit, and a second electrode of the fourth transistor T4 is connected to the second end of the storage capacitor Cst.

It should be noted that, the initialization module 10 may further comprise a plurality of switching transistors that are connected in parallel with the second transistor T2, and/or a plurality of switching transistors that are connected in parallel with the third transistor T3, and/or a plurality of switching transistors that are connected in parallel with the fourth transistor T4. What have been described above is merely exemplary illustration of the initialization module 10, and other structures having the same functions as the initialization module 10 will not be described in detail herein, but are all intended to fall within the protection scope of the present disclosure.

More specifically, as shown in FIG. 3, the gate electrode of the first transistor T1 is connected to the enable signal terminal EM, the first electrode of the first transistor T1 is connected to the second electrode of the fourth transistor T4, and the second electrode of the first transistor T1 is connected to the gate electrode of the fourth transistor T4.

As shown in FIG. 3, the data write and compensation module 20 comprises a fifth transistor T5 and a sixth transistor T6 for example.

A gate electrode of the fifth transistor T5 is connected to the scan signal terminal S2, a first electrode of the fifth transistor T5 is connected to the data voltage terminal Vdata, and a second electrode of the fifth transistor T5 is connected to the first end of the storage capacitor Cst.

A gate electrode of the sixth transistor T6 is connected to the scan signal terminal S2, a first electrode of the sixth transistor T6 is connected to the second electrode of the driving transistor Td, and a second electrode of the sixth transistor T6 is connected to the second end of the storage capacitor Cst.

It should be noted that, the data write and compensation module 20 may further comprise a plurality of switching transistors that are connected in parallel with the fifth transistor T5, and/or a plurality of switching transistors that are connected in parallel with the sixth transistor T6. What have been described above is merely exemplary illustration of the data write and compensation module 20, and other structures having the same functions as the data write and compensation module 20 will not be described in detail herein, but are all intended to fall within the protection scope of the present disclosure.

As shown in FIG. 3, the light-emitting unit 40 comprises a seventh transistor T7, an eighth transistor T8, and a light-emitting component L for example.

A gate electrode of the seventh transistor T7 is connected to the enable signal terminal EM, a first electrode of the seventh transistor T7 is connected to the first voltage terminal V1, and a second electrode of the seventh transistor T7 is connected to the first end of the storage capacitor Cst.

A gate electrode of the eighth transistor T8 is connected to the enable signal terminal EM, a first electrode of the eighth transistor T8 is connected to the second electrode of the driving transistor Td, and a second electrode of the eighth transistor T8 is connected to an anode of the light-emitting component L.

A cathode of the light-emitting component L is connected to the third voltage terminal V3.

The seventh transistor T7 and the eighth transistor T8 are first-type transistors, and the first transistor T1 is a second-type transistor.

For example, the seventh transistor T7 and the eighth transistor T8 are P-type transistors, and the first transistor T1 is an N-type transistor. That is, in the pixel circuit, the seventh transistor T7 and the eighth transistor T8 are turned on under the control of a low voltage, and the first transistor T1 is turned on under the control of a high voltage.

Alternatively, the seventh transistor T7 and the eighth transistor T8 are N-type transistors, and the first transistor T1 is a P-type transistor. That is, in the pixel circuit, the seventh transistor T7 and the eighth transistor T8 are turned on under the control of a high voltage, and the first transistor T1 is turned on under the control of a low voltage.

In summary, in the pixel circuit provided by the embodiments of the present disclosure, when the seventh transistor T7 and the eighth transistor T8 in the light-emitting unit 40 are turned on, the first transistor T1 in the leakage-current eliminating module 50 is turned off; when the seventh transistor T7 and the eighth transistor T8 in the light-emitting unit 40 are turned off, the first transistor T1 in the leakage-current eliminating module 50 is turned on.

It should be noted that, the light-emitting unit 40 may further comprise a plurality of switching transistors that are connected in parallel with the seventh transistor T7, and/or a plurality of switching transistors that are connected in parallel with the eighth transistor T8. What have been described above is merely exemplary illustration of the light-emitting unit 40, and other structures having the same functions as the light-emitting unit 40 will not be described in detail herein, but are all intended to fall within the protection scope of the present disclosure.

Based on the above descriptions of the specific circuits of the respective modules, a specific driving process of the above pixel drive circuit will be described in detail below in conjunction with FIGS. 3 and 4.

It should be noted that, first, the embodiment of the present disclosure does not limit types of transistors in respective modules and units, that is, the driving transistor Td, the first transistor T1, the second transistor T2, the third transistor T3, the fourth transistor T4, the fifth transistor T5, the sixth transistor T6, the seventh transistor T7, and the eighth transistor T8 may be N-type transistors or P-type transistors, however, the type of the seventh transistor T7 and the type of the eighth transistor T8 are opposite to the type of the first transistor T1. The driving transistor Td, the second transistor T2, the third transistor T3, the fourth transistor T4, the fifth transistor T5, the sixth transistor T6, the seventh transistor T7, and the eighth transistor T8 are P-type transistors, and the first transistor T1 is an N-type transistor, which is taken as an example to describe the following embodiment of the present disclosure.

For example, first electrodes of the above transistors may be drain electrodes, and second electrodes of the above transistors may be source electrodes; or, the first electrodes may be the source electrodes, and the second electrodes may be the drain electrodes. The embodiments of the present disclosure are not limited thereto.

In addition, according to different conductive manners of the transistors, the transistors in the above pixel circuit may be classified into enhancement-type transistors and depletion-type transistors, which is not limited in the embodiment of the present disclosure.

Secondly, the embodiments of the present disclosure are all described by taking the case where a high level is input to the second voltage terminal V2 and a low level is input to the third voltage terminal V3 or the third voltage terminal V3 is grounded, as an example, moreover, the high level and low level herein only indicate a relative magnitude relationship between the input voltages.

Figure 4:
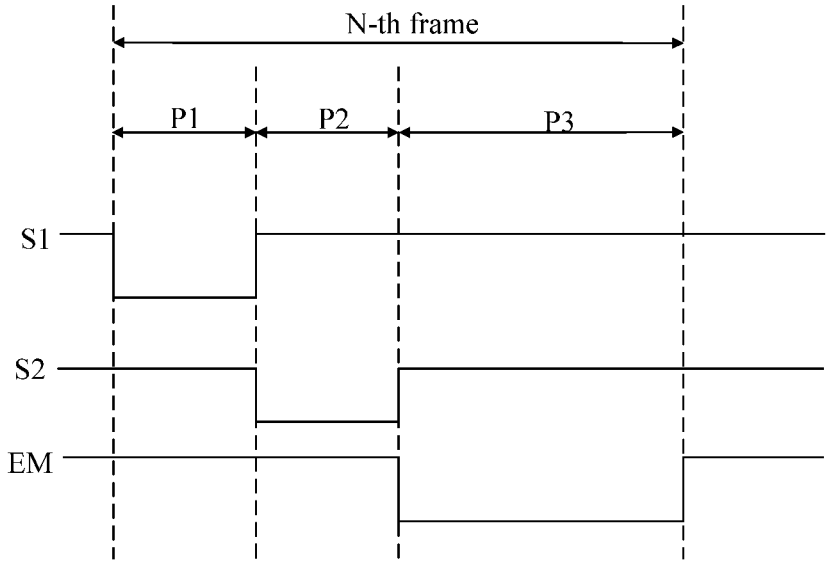
FIG. 4 is a timing diagram of respective signals for driving the pixel circuit shown in FIG. 3.

As shown in FIG. 4, a display process of each frame of the pixel circuit can be divided into an initialization phase P1, a data writing and compensating phase P2 and a light-emitting phase P3.

Figure 5:
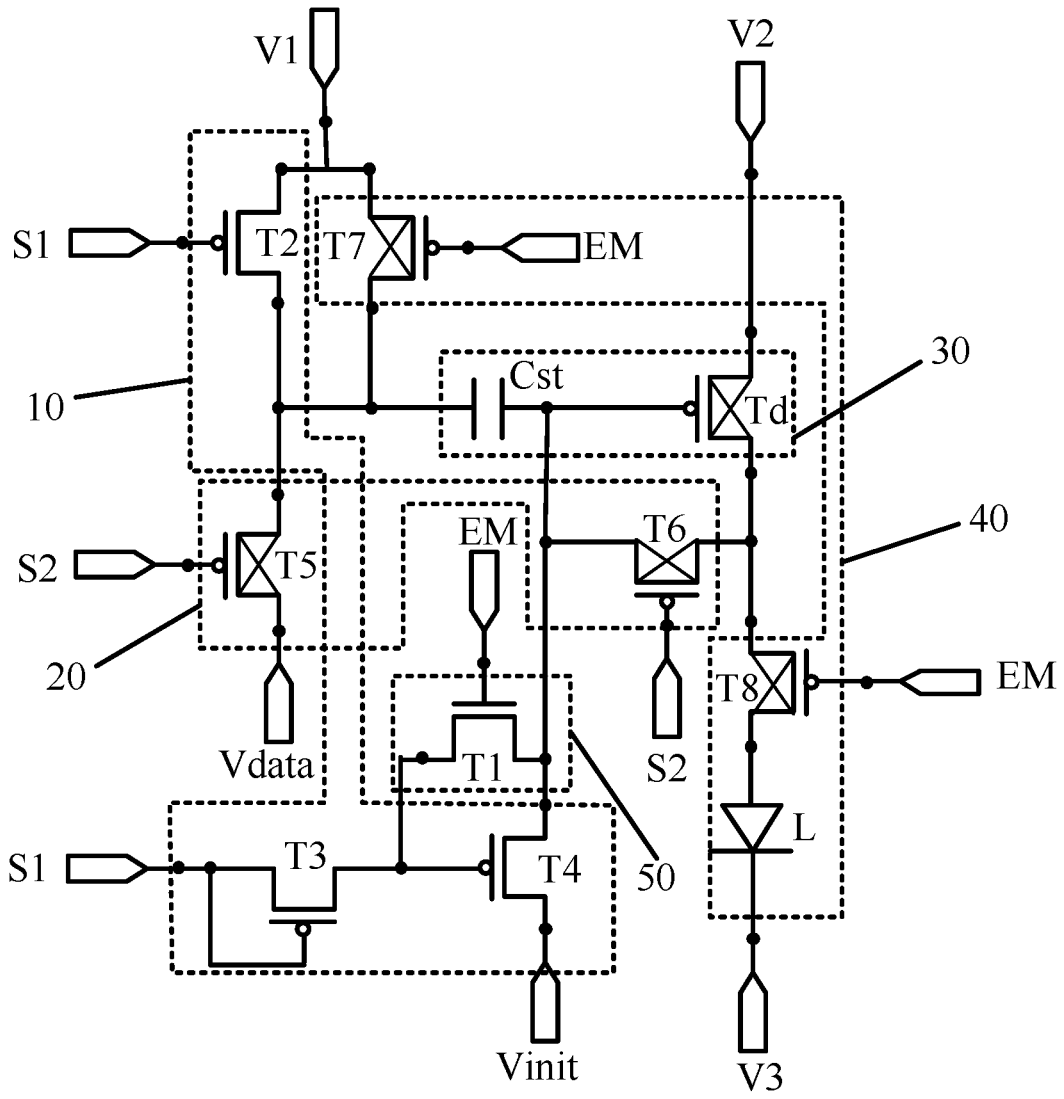
FIGS. 5-7 are exemplary equivalent circuit diagrams of the pixel circuit shown in FIG. 3 corresponding to different situations.

In the initialization phase P1, a low level signal is input to the first signal terminal S1, and a high level signal is input to the enable signal terminal EM and a high level signal is input to the scan signal terminal S2. In this way, an equivalent circuit diagram of the pixel circuit shown in FIG. 3 is shown in FIG. 5. The first transistor T1, the second transistor T2, the third transistor T3 and the fourth transistor T4 are all turned on, the fifth transistor T5, the sixth transistor T6, the seventh transistor T7, the eighth transistor T8 and the driving transistor Td are all turned off (the transistor or transistors in a turn-off state are indicated by "X").

For example, the second transistor T2 is turned on, so the voltage of the first voltage terminal V1 is written to the first end of the storage capacitor Cst; the third transistor T3 and the fourth transistor T4 are turned on, so the voltage of the initial voltage terminal Vinit is written to the second end of the storage capacitor Cst, so as to initialize voltages of two ends of the storage capacitor Cst. In addition, the voltage of the initial voltage terminal Vinit should be higher than the turn-on voltage of the driving transistor Td, and when the voltage of the initial voltage terminal Vinit is written to the second end of the storage capacitor Cst, the driving transistor Td should remain in a turn-off state.

Figure 6:
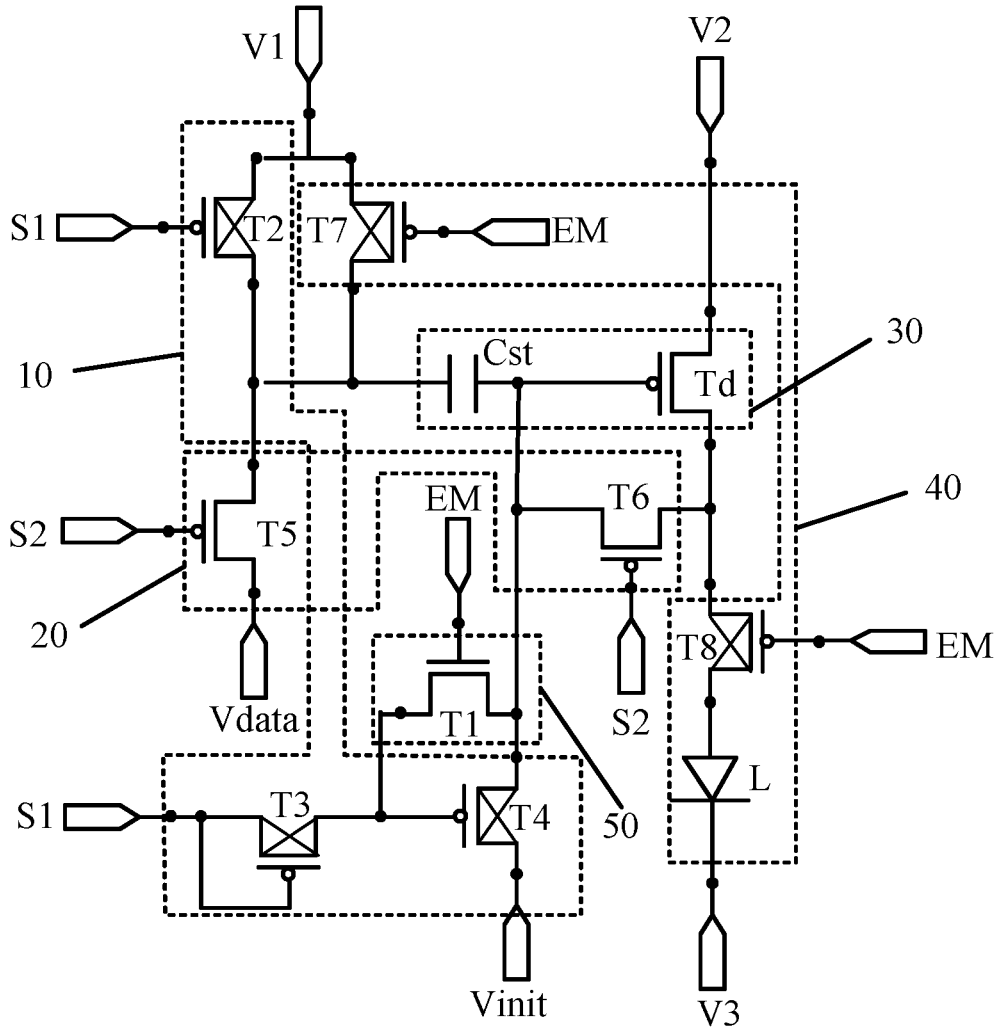

In the data writing phase P2, a low level signal is input to the scan signal terminal S2, and a high level signal is input to the first signal terminal S1 and a high level signal is input to the enable signal terminal EM. In this way, an equivalent circuit diagram of the pixel circuit shown in FIG. 3 is shown in FIG. 6. The first transistor T1, the fifth transistor T5, the sixth transistor T6 and the driving transistor Td are all turned on, and the second transistor T2, the third transistor T3, the fourth transistor T4, the seventh transistor T7 and the eighth transistor T8 are all turned off.

For example, the fifth transistor T5 is turned on, so the voltage of the data voltage terminal Vdata is written to the first end of the storage capacitor Cst, the voltage at the first end of the storage capacitor Cst changes from V1 to Vdata, and the change quantity is $\Delta V1=V1-Vdata$, thus the voltage at the second end of the storage capacitor Cst becomes $Vinit-\Delta V1$. In this situation, the voltage at the second end of the storage capacitor Cst controls the driving transistor Td to be turned on. When both the driving transistor Td and the sixth transistor T6 are turned on, the voltage of the second voltage terminal V2 is written to the second end of the storage capacitor Cst via the driving transistor Td and the sixth transistor T6. Because the driving transistor Td has a threshold voltage Vth, the voltage at the second end of the storage capacitor Cst becomes V2+Vth at this time. The voltage at the second end of the storage capacitor Cst rises, and is higher than the turn-on voltage for controlling the driving transistor Td, so as to control the driving transistor Td to be turned off.

On this basis, the first transistor T1 is turned on, the voltage at the second end of the storage capacitor Cst (the gate electrode of the driving transistor Td) is written to the second electrode of the fourth transistor T4, and then is written to the gate electrode of the fourth transistor T4 via the first transistor T1, thus the gate electrode and the second electrode of the fourth transistor T4 are short-circuited, that is, the gate-source voltage Vgs of the fourth transistor T4 is zero (0). According to the characteristics of the transistors, the P-type transistor has no threshold voltage loss when the P-type transistor transmits a low potential, and the N-type transistor has no threshold voltage loss when the N-type transistor transmits a high potential.

At this situation, under the function of the third transistor T3 (the third transistor T3 is in a turn-off state), the signal of the first signal terminal S1 can be prevented from being written to the gate electrode of the driving transistor Td via the first transistor T1, thereby avoiding affecting the potential of the gate electrode of the driving transistor Td and affecting the display in the display phase.

Figure 7:
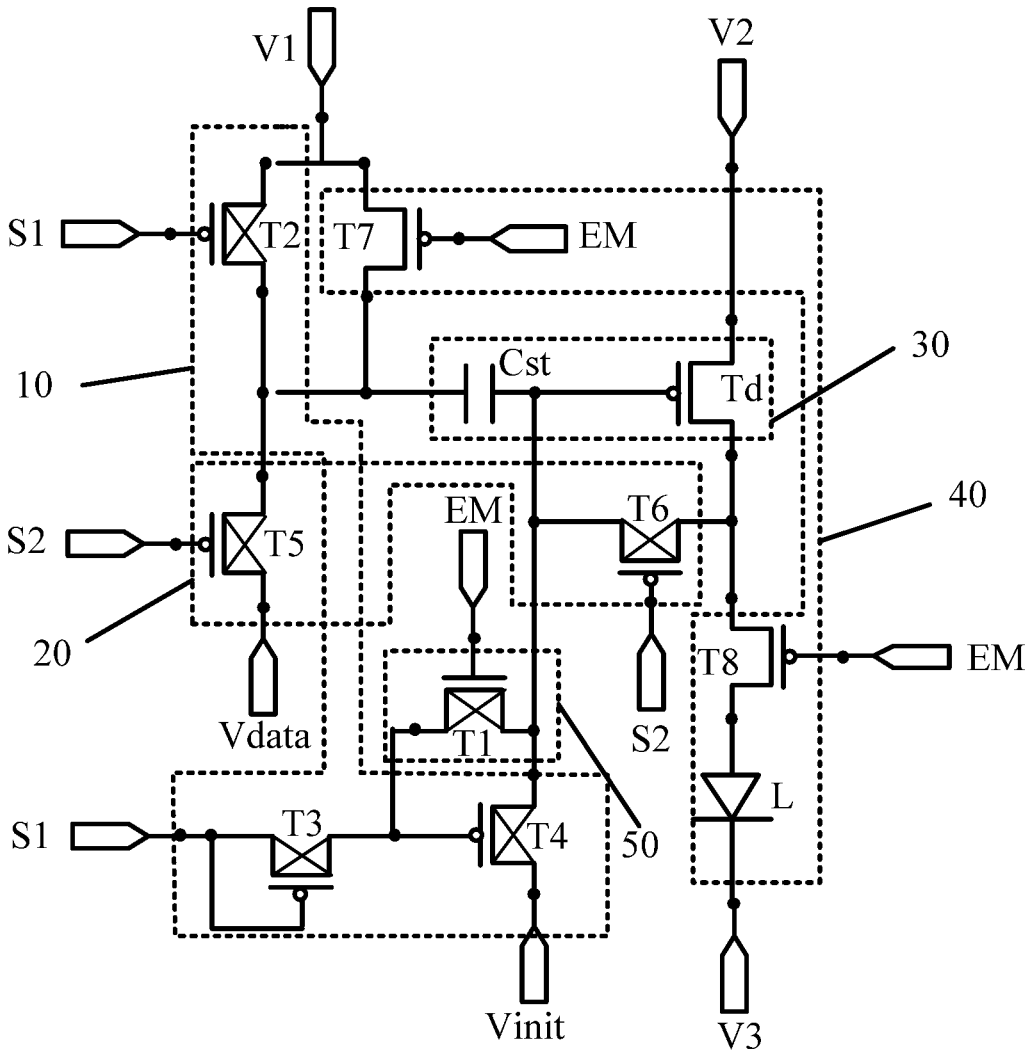

In the light-emitting phase P3, a low level signal is input to the enable signal terminal EM, and a high level signal is input to the first signal terminal S1 and a high level signal is input to the scan signal terminal S2. Based on this, an equivalent circuit diagram of the pixel circuit shown in FIG. 3 is shown in FIG. 7. The seventh transistor T7, the eighth transistor T8 and the driving transistor Td are all turned on, and the first transistor T1, the second transistor T2, the third transistor T3, the fourth transistor T4, the fifth transistor T5 and the sixth transistor T6 are all turned off.

For example, the seventh transistor T7 is turned on, so the voltage of the first voltage terminal V1 is written to the first end of the storage capacitor Cst, the voltage at the first end of the storage capacitor Cst changes from Vdata to V1, and the change quantity is ΔV2=Vdata−V1, based on this, the voltage at the second end of the storage capacitor Cst becomes V2+Vth−ΔV2=V2+Vth−Vdata+V1. In this situation, the voltage at the second end of the storage capacitor Cst drops and controls the driving transistor Td to be turned on. When both the driving transistor Td and the eighth transistor T8 are turned on, the voltage of the second voltage terminal V2 is written to the anode of the light-emitting component L via the driving transistor Td and the eighth transistor T8. The voltage of the third voltage terminal V3 is written to the cathode of the light-emitting component L, and in this situation, the light-emitting component L starts to display an image.

In the light-emitting phase P3, after the driving transistor Td is turned on, when the value obtained by subtracting the threshold voltage Vth of the driving transistor Td from the gate-source voltage Vgs of the driving transistor Td is less than or equal to the drain-source voltage Vds of the driving transistor Td, that is, when Vgs−Vth≤Vds, the driving transistor Td can be in a saturation turn-on state, at this time, a driving current I flowing through the driving transistor Td is:

$$I = \frac{1}{2}K(V_{gs} - V_{th})^2 = \frac{1}{2}K[(V_2 + V_{th} - V_{data} + V_1) - V_2 - V_{th}]^2 = \frac{1}{2}K(V_1 - V_{data})^2.$$

Here, K=W/L×C×u, W/L is the ratio of width to length of the driving transistor Td, C is the capacitance of the channel insulating layer, and u is the channel carrier mobility.

The above parameters are only related to the structure of the driving transistor Td, and therefore, the current flowing through the driving transistor Td is merely related to the data voltage which is used for implementing display and outputted by the data voltage terminal Vdata, and the voltage outputted by the first voltage terminal V1, the current is not related to the threshold voltage Vth of the driving transistor Td, thereby eliminating the influence of the threshold voltage Vth of the driving transistor Td on the luminance of the light-emitting component L, and improving the uniformity of the luminance of the light-emitting component L.

On this basis, in the light-emitting phase P3, because a gate-source voltage Vgs of the fourth transistor T4 is 0 (in the above data writing phase P2, the gate-source voltage Vgs of the fourth transistor T4 has been set to 0), and the fourth transistor T4 has no threshold voltage loss, that is, the threshold voltage Vth=0. At this time, a current I flowing through the fourth transistor T4 is:

$$I=\tfrac{1}{2}K(V_{gs}-V_{th})^2=0.$$

Hence, no leakage current is generated over the path through transistors Td-T6-T4, so the flicker generated by the light-emitting component L during the light-emitting process can be reduced, the efficiency of the display panel can be improved, and the power consumption can be reduced to some extent.

For example, in the data writing phase P2, under the control of the enable signal terminal, the first transistor T1 is turned on, so the gate-source voltage of the fourth transistor T4 is zero voltage; and in the light-emitting phase P3, the first transistor T1 is turned off, the fourth transistor T4 is turned off, and the current of the fourth transistor T4 is a current of zero, thus no signal is output to the initial voltage terminal Vinit (that is, no leakage current is output to the initial voltage terminal Vinit via the fourth transistor T4).

For example, the ranges of operation voltages (V1/S1/Vinit/Vdata) of the pixel circuit determine the range of the gate voltage of the driving transistor Td. In an existing pixel circuit, the gate voltage of the driving transistor Td may be a negative value, and may also be a positive value, and this design can optimize the leakage currents of a part of gray scales for some pixel circuits. For example, in a case where the gate voltage of the driving transistor Td is a positive value, the gate electrode attracts negative charges, the larger the absolute value of the attracted negative charges (less than a reverse breakdown voltage), the smaller the current between the source electrode and the drain electrode. Therefore, in the case where the gate voltage of the driving transistor Td is a positive value, the current flowing through the driving transistor Td itself is small, the leakage current is smaller, so the optimization effect is not significant.

In a case where the gate voltage of the driving transistor Td is a negative value, the gate electrode attracts positive charges, the larger the absolute value of the attracted positive charges, the larger the current between the source electrode and the drain electrode. Thus, in the case where the gate voltage of the driving transistor Td is a negative value, the current flowing through the driving transistor Td is relatively large, and the leakage current has a great influence on the light-emitting component. In this regard, the pixel circuit provided by the embodiment of the present disclosure can eliminate the leakage current.

An embodiment of the present disclosure provides a display device, comprising any one of the pixel circuits as described above. The display device may comprise a pixel unit array, and each pixel unit comprises any one of the pixel circuits as described above. The display device provided by the embodiment of the present disclosure has the same or similar advantages as the pixel circuit provided by the foregoing embodiments of the present disclosure, because the pixel circuit has been described in detail in the foregoing embodiments, and the redundant portions will be omitted here.

Figure 8:
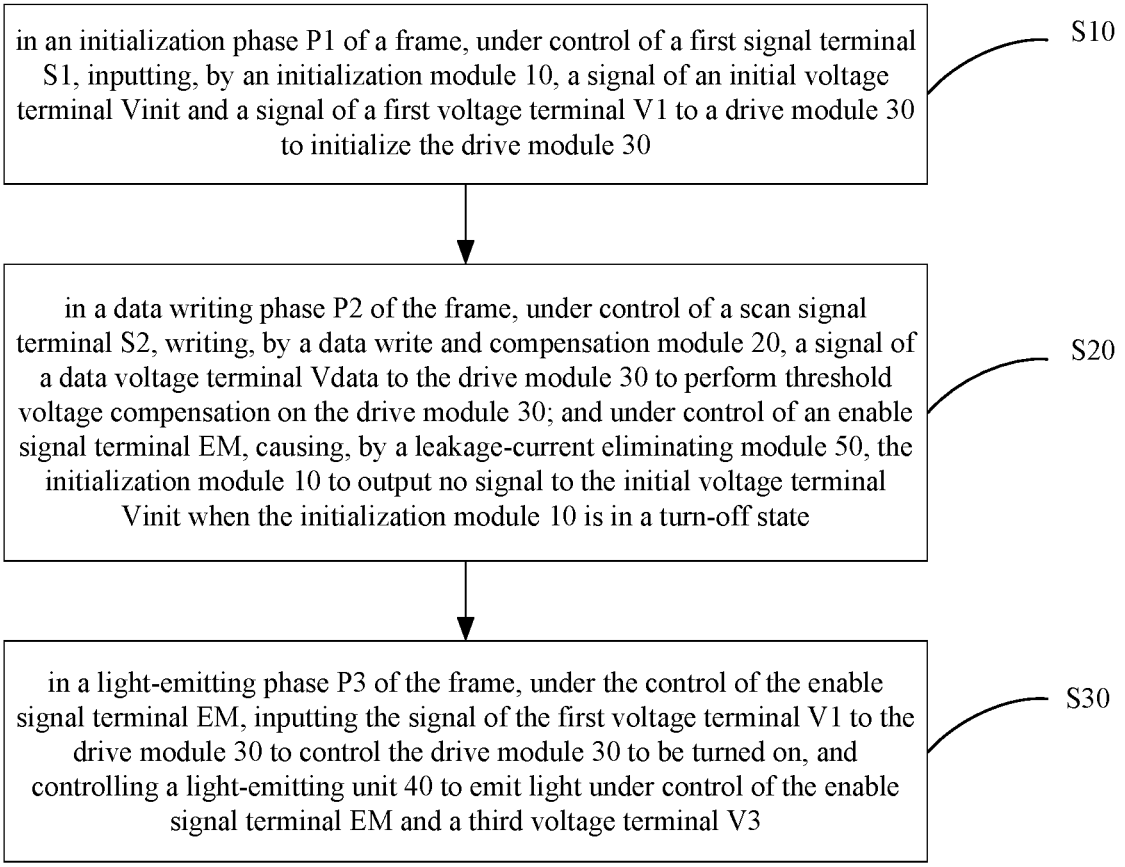
FIG. 8 is a schematic flow chart of a driving method of a pixel circuit provided by an embodiment of the present disclosure.

An embodiment of the present disclosure further provides a driving method of a pixel circuit, as shown in FIG. 8, the driving method comprises the following operations:

S10, in an initialization phase P1 of a frame, under the control of a first signal terminal S1, inputting, by an initialization module 10, a signal of an initial voltage terminal Vinit and a signal of a first voltage terminal V1 to a drive module 30 to initialize the drive module 30.

S20, in a data writing phase P2 of the frame, under the control of a scan signal terminal S2, writing, by a data write and compensation module 20, a signal of a data voltage terminal Vdata to the drive module 30 to perform threshold voltage compensation on the drive module 30.

Under the control of an enable signal terminal EM, causing, by a leakage-current eliminating module 50, the initialization module 10 to output no signal to the initial voltage terminal Vinit when the initialization module 10 is in a turn-off state.

S30, in a light-emitting phase P3 of the frame, under the control of the enable signal terminal EM, inputting the signal of the first voltage terminal V1 to the drive module 30 to control the drive module 30 to be turned on, and controlling a light-emitting unit 40 to emit light under the control of the enable signal terminal EM and a third voltage terminal V3.

Because the current of a light-emitting component (such as, an organic light-emitting diode) in a single pixel is only in an nA level during the light-emitting phase, even a small leakage current has a significant influence on the light-emitting phase. An embodiment of the present disclosure provides a driving method of a pixel circuit, the leakage-current eliminating module 50 connected to the initialization module 10 is added in the pixel circuit, so that in a phase when the initialization module 10 is turned off, under the control of the leakage-current eliminating module 50, the initialization module 10 has no signal to output to the initial voltage terminal Vinit (that is, in the light-emitting phase, the current flowing to the light-emitting component does not leak into other paths), thereby ensuring the stability of the current flowing into the light-emitting unit 40, avoiding a flicker problem of the light-emitting unit 40 during the light emitting process, and reducing power consumption of the pixel circuit to some extent.

For example, in a case where the first transistor T1 is an N-type transistor, other transistors are P-type transistors, under the control of the enable signal terminal EM, causing, by the leakage-current eliminating module 50, the initialization module 10 to output no signal to the initial voltage terminal Vinit when the initialization module 10 is in a turn-off state, specifically comprises: in the data writing phase, controlling the first transistor t1 to be turned on by the enable signal terminal EM, inputting the voltage of a second end of the storage capacitor Cst to a gate electrode of the fourth transistor T4 via the first transistor T1, making a voltage of the gate electrode of the fourth transistor T4 and the voltage of a second electrode of the fourth transistor T4 both equal to the voltage of the second end of the storage capacitor Cst, the gate-source voltage of the fourth transistor T4 being zero voltage.

That is, the enable signal terminal EM controls the first transistor T1 to be turned on, so the gate-source voltage Vgs of the fourth transistor T4 is zero.

In the light-emitting phase, the enable signal terminal controls the first transistor to be turned off and the fourth transistor to be turned off, and the current of the fourth transistor is zero, so that no signal is output to the initial voltage terminal.

What have been described above are only specific implementations of the present disclosure, the protection scope of the present disclosure is not limited thereto. Any modifications or substitutions easily occur to those skilled in the art within the technical scope of the present disclosure should be within the protection scope of the present disclosure. Therefore, the protection scope of the present disclosure should be based on the protection scope of the claims.

What is claimed is:

1. A pixel circuit, comprising: an initialization sub-circuit, a data write and compensation sub-circuit, a drive sub-circuit, a light-emitting sub-circuit, and a leakage-current eliminating sub-circuit, wherein the initialization sub-circuit is configured to be respectively connected to the drive sub-circuit, a first signal terminal, a first voltage terminal and an initial voltage terminal, and is configured to, under control of the first signal terminal, input a signal of the initial voltage terminal and a signal of the first voltage terminal to the drive sub-circuit to initialize the drive sub-circuit;

the data write and compensation sub-circuit is configured to be respectively connected to the drive sub-circuit, a scan signal terminal and a data voltage terminal, and is configured to, under control of the scan signal terminal, write a signal of the data voltage terminal to the drive sub-circuit to perform threshold voltage compensation on the drive sub-circuit;

the drive sub-circuit is configured to be further connected to the light-emitting sub-circuit and a second voltage terminal, and is configured to output a signal of the second voltage terminal to the light-emitting sub-circuit in a turn-on state, so as to drive the light-emitting sub-circuit to emit light;

the light-emitting sub-circuit is configured to be further connected to the first voltage terminal, an enable signal terminal and a third voltage terminal, and is configured to, under control of the enable signal terminal, input the signal of the first voltage terminal to the drive sub-circuit to control the drive sub-circuit to be turned on, and emit light under control of the enable signal terminal and the third voltage terminal; and the leakage-current eliminating sub-circuit is configured to be respectively connected to the initialization sub-circuit, the drive sub-circuit and the enable signal terminal, and is configured to, under control of the enable signal terminal, cause the initialization sub-circuit to output no signal to the initial voltage terminal when the initialization sub-circuit is in a turn-off state;

wherein the leakage-current eliminating sub-circuit comprises a first transistor, a gate electrode of the first transistor is connected to the enable signal terminal, a first electrode of the first transistor is connected to the drive sub-circuit, and a second electrode of the first transistor is connected to the initialization sub-circuit.

2. The pixel circuit according to claim 1, wherein the drive sub-circuit comprises a storage capacitor and a driving transistor, a first end of the storage capacitor is connected to the initialization sub-circuit, the data write, compensation sub-circuit, and the light-emitting sub-circuit, and a second end of the storage capacitor is connected to a gate electrode of the driving transistor; and a first electrode of the driving transistor is connected to the second voltage terminal, and a second electrode of the driving transistor is connected to the light-emitting sub-circuit, the data write and compensation sub-circuit.

3. The pixel circuit according to claim 2, wherein the initialization sub-circuit comprises a second transistor, a third transistor and a fourth transistor;

a gate electrode of the second transistor is connected to the first signal terminal, a first electrode of the second transistor is connected to the first voltage terminal, and a second electrode of the second transistor is connected to the first end of the storage capacitor;

a gate electrode of the third transistor is connected to the first signal terminal, a first electrode of the third transistor is connected to the first signal terminal, and a second electrode of the third transistor is connected to a gate electrode of the fourth transistor; and a first electrode of the fourth transistor is connected to the initial voltage terminal, and a second electrode of the fourth transistor is connected to the second end of the storage capacitor.

4. The pixel circuit according to claim 2, wherein the data write and compensation sub-circuit comprises a fifth transistor and a sixth transistor;

a gate electrode of the fifth transistor is connected to the scan signal terminal, a first electrode of the fifth transistor is connected to the data voltage terminal, and a second electrode of the fifth transistor is connected to the first end of the storage capacitor; and a gate electrode of the sixth transistor is connected to the scan signal terminal, a first electrode of the sixth transistor is connected to the second electrode of the driving transistor, and a second electrode of the sixth transistor is connected to the second end of the storage capacitor.

5. The pixel circuit according to claim 2, wherein the light-emitting sub-circuit comprises a seventh transistor, an eighth transistor, and a light-emitting component;

a gate electrode of the seventh transistor is connected to the enable signal terminal, a first electrode of the seventh transistor is connected to the first voltage terminal, and a second electrode of the seventh transistor is connected to the first end of the storage capacitor;

a gate electrode of the eighth transistor is connected to the enable signal terminal, a first electrode of the eighth transistor is connected to the second electrode of the driving transistor, and a second electrode of the eighth transistor is connected to an anode of the light-emitting component;

a cathode of the light-emitting component is connected to the third voltage terminal; and the seventh transistor and the eighth transistor are first-type transistors, and the first transistor is a second-type transistor.

6. The pixel circuit according to claim 5, wherein the seventh transistor and the eighth transistor are P-type transistors and the first transistor is an N-type transistor; or the seventh transistor and the eighth transistor are N-type transistors and the first transistor is a P-type transistor.

7. The pixel circuit according to claim 3, wherein the gate electrode of the first transistor is connected to the enable signal terminal, the first electrode of the first transistor is connected to the second electrode of the fourth transistor, and the second electrode of the first transistor is connected to the gate electrode of the fourth transistor.

8. A display device, comprising the pixel circuit according to claim 1.

9. A driving method of a pixel circuit, comprising:

in an initialization phase of a frame, under control of a first signal terminal, inputting, by an initialization sub-circuit, a signal of an initial voltage terminal and a signal of a first voltage terminal to a drive sub-circuit to initialize the drive sub-circuit;

in a data writing phase of the frame, under control of a scan signal terminal, writing a signal of a data voltage terminal to the drive sub-circuit to perform threshold voltage compensation on the drive sub-circuit; under control of an enable signal terminal, causing, by a leakage-current eliminating sub-circuit, the initialization sub-circuit to output no signal to the initial voltage terminal when the initialization sub-circuit is in a turn-off state;

in a light-emitting phase of the frame, under the control of the enable signal terminal, inputting a signal of the first voltage terminal to the drive sub-circuit to control the drive sub-circuit to be turned on, and controlling a light-emitting sub-circuit to emit light under control of the enable signal terminal and a third voltage terminal;

wherein the leakage-current eliminating sub-circuit comprises a first transistor, the initialization sub-circuit comprises a fourth transistor, and the drive sub-circuit comprises a storage capacitor, under the control of the enable signal terminal, causing, by the leakage-current eliminating sub-circuit, the initialization sub-circuit to output no signal to the initial voltage terminal when the initialization sub-circuit is in a turn-off state, comprises:

in the data writing phase, controlling the first transistor to be turned on by the enable signal terminal, inputting a voltage of a second end of the storage capacitor to a gate electrode of the fourth transistor via the first transistor, making a voltage of the gate electrode of the fourth transistor and a voltage of a second electrode of the fourth transistor both equal to the voltage of the second end of the storage capacitor, a gate-source voltage of the fourth transistor being zero voltage;

wherein in the light-emitting phase, the enable signal terminal controls the first transistor to be turned off and the fourth transistor to be turned off, a current of the fourth transistor is zero, so that no signal is output to the initial voltage terminal.

* * * * *